US005372926A

United States Patent [19]

Beavers et al.

[11] Patent Number: 5,372,926

[45] Date of Patent: Dec. 13, 1994

[54] TRANSITION METAL COMPLEX WITH NITROSYL LIGAND DOPANT AND IRIDIUM DOPANT COMBINATIONS IN SILVER HALIDE

[75] Inventors: Dorothy J. Beavers, Rochester; Gladys L. MacIntyre, Clyde, both of N.Y.

[73] Assignee: Eastman Kodak Company, Rochester, N.Y.

[21] Appl. No.: 30,683

[22] Filed: Mar. 12, 1993

Related U.S. Application Data

[63] Continuation of Ser. No. 673,612, Mar. 22, 1991, abandoned.

[51] Int. Cl.[5] ..... G03C 1/09

[52] U.S. Cl. ..... 430/567; 430/605

[58] Field of Search ..... 430/567, 569, 604, 605

[56] References Cited

U.S. PATENT DOCUMENTS

| | | | |
|---|---|---|---|
| 2,717,833 | 9/1955 | Wark | 430/596 |
| 3,672,901 | 6/1972 | Ohkubo et al. | 430/540 |
| 3,790,387 | 2/1974 | Musliner | 430/569 |
| 3,890,154 | 6/1975 | Ohkubo et al. | 430/434 |
| 3,982,950 | 9/1976 | Shiba et al. | 430/567 |
| 4,147,542 | 4/1979 | Habu et al. | 430/346 |
| 4,173,483 | 11/1979 | Habu et al. | 430/575 |
| 4,431,730 | 2/1984 | Urabe et al. | 430/569 |
| 4,439,520 | 3/1984 | Kofron et al. | 430/567 |
| 4,806,462 | 2/1989 | Yamashita et al. | 430/605 |
| 4,835,093 | 5/1989 | Janusonis et al. | 430/567 |
| 4,933,272 | 6/1990 | McDugle et al. | 430/567 |
| 4,997,751 | 3/1991 | Kim | 430/569 |
| 5,219,722 | 6/1993 | Tanaka et al. | 430/604 |
| 5,227,286 | 7/1993 | Kuno et al. | 430/604 |
| 5,229,263 | 7/1993 | Yoshida et al. | 430/600 |

FOREIGN PATENT DOCUMENTS

| | | |
|---|---|---|
| 0312999 | 4/1989 | European Pat. Off. . |
| 325235 | 7/1989 | European Pat. Off. . |
| 0336425 | 10/1989 | European Pat. Off. . |
| 0336427 | 10/1989 | European Pat. Off. . |

*Primary Examiner*—Janet C. Baxter
*Attorney, Agent, or Firm*—Paul A. Leipold

[57] ABSTRACT

The invention is generally accomplished by providing a halide emulsion comprising radiation sensitive silver halide doped with a combination of iridium and transition metal complex with a nitrosyl ligand. The method of doping comprises one in which the transition metal complex with a nitrosyl ligand is generally evenly distributed throughout the grain and the iridium is present in about the outer 10 percent, by volume, of said grain. In a preferred form, the transition metal complex with a nitrosyl ligand is present in an amount between about 0.03 and about 36 molar parts per billion, and the iridium is present in an amount of between about 10 and about 350 molar parts per billion.

8 Claims, No Drawings

TRANSITION METAL COMPLEX WITH NITROSYL LIGAND DOPANT AND IRIDIUM DOPANT COMBINATIONS IN SILVER HALIDE

This is a continuation of application Ser. No. 673,612, filed Mar. 22, 1991, now abandoned.

TECHNICAL FIELD

This invention relates to the formation of silver halide grains for photographic uses, It particularly relates to incorporation of metal complexes during the formation of the silver halide grains,

BACKGROUND ART

It is known in photography that silver halide grains are useful informing developable latent images when struck by actinic radiation, such as electromagnetic radiation. The use of silver bromide, silver chloride, silver iodide, and combinations of these metal halides into crystals have been widely used in photographic products.

In the formation of color photographic products both for color negative film, transparencies, and color paper, there has been a continuous improvement in the properties of these materials, particularly in their speed and fine grain properties.

However, there remains a need for such materials that have higher contrast, lower fog, and improved reciprocity over wide exposure ranges.

As shown in *Research Disclosure,* December 1989, 308119, Sections I–IV at pages 993–1000, there have been a wide variety of dopants, spectral sensitizers and chemical sensitizers proposed for addition to emulsions of gelatin and silver halide grains or crystals. These materials have been proposed for addition during emulsion making as dopants or after emulsion formation as sensitizers. However, there remains a continued need for an improvement in the use of such materials to obtain better photographic performance.

U.S. Pat. No. 4,933,272 by McDugle et al discloses formation of silver halide grains exhibiting a face centered cubic crystal lattice structure internally containing a nitrosyl or thionitrosyl coordination ligand and a transition metal chosen from groups 5 to 10 inclusive of the periodic table of elements. These complexes play a significant role in modifying photographic performance.

U.S. Pat. No. 4,806,462 by Yamashita et al, at column 4, discloses formation of silver halide photographic material that may be doped with a variety of metals including magnesium, calcium, barium, aluminum, strontium, rheuthium, rhodium, lead, osmium, iridium, platinum, cadmium, mercury, and manganese.

However, there remains a need for improved photographic products that have a sharper toe (higher contrast) at low exposures while maintaining reciprocity during exposure. There is particular need for color print materials that have these properties.

DISCLOSURE OF THE INVENTION

An object of the invention is to overcome disadvantages of the prior processes.

A further object of the invention is to provide improved photographic products.

Another object of the invention is to provide photographic paper having improved speed at long exposure, low intensity exposures.

Another object of the invention is to provide photographic papers having improved contrast.

These and other objects of the invention are generally accomplished by providing a halide emulsion comprising radiation sensitive silver halide doped with a combination of iridium and a transition metal complex with a nitrosyl ligand, hereafter called "nitrosyl complex". The method of doping comprises one in which the nitrosyl complex is generally evenly distributed throughout the grain and the iridium is present in about the outer 10 percent, by volume, of said grain.

In a preferred form, the nitrosyl complex is present in an amount between about 0.03 and about 36 molar parts per billion, and the iridium is present in an amount of between about 10 and about 350 molar parts per billion. The selection of the preferred amount is dependent on the size of the emulsion grain with less dopant needed for larger grains.

MODES FOR CARRYING OUT THE INVENTION

The invention has numerous advantages over prior methods of forming silver halide emulsions and the silver halide grains produced by these methods. The invention provides an improved method of controlling photographic response. The method provides improved contrast, particularly at longer exposure times. The invention provides improved speed at low intensity exposures for photographic products utilizing the doped silver halides of the invention. The invention further has the advantage that the iridium and nitrosyl complex do not interfere with other sensitizer or additives that may be present in the finish of the silver halide grain. These and other advantages will be apparent from further consideration of the specification below. Silver halide emulsions may be formed by techniques that are well known in the art. The common techniques normally utilized are referred to as single-jet and double-jet precipitation. Either of these techniques may be utilized in the invention. Further, the process may be carried out with nucleation of silver halide grains in a separate mixer or first container with later growth in a second container. Such techniques are known and referenced in the patents discussed in Sections I–IV of the *Research Disclosure,* December 1989, 308119 referenced above. It is believed that the invention may be practiced with any of the known techniques for emulsion preparation.

The invention and the method of precipitation may utilize any of the known silver halide grains. These are combinations of the halides of chlorine, bromine and iodine with silver. The invention has been found to be preferred for use with silver chloride grains which are commonly used in color print papers. Its use is preferred with color print papers as the high contrast at low exposure is particularly important, and the effect of a nitrosyl complex and iridium have been found to be significant. However, it is believed that the advantages of the invention would be present with the tabular grain, black-and-white and color films utilizing the bromide and bromoiodide tabular or other types of bromoiodide grains.

The amount of transition metal nitrosyl complex utilized may be any amount that, in combination with the iridium, produces the desired increase in contrast. Although somewhat dependent on the size of the emulsion grain, the amount of nitrosyl complex suitably is between about 0.03 and about 36 molar parts per billion of the silver chloride grain.

The amount of iridium added may be any amount that gives the desired improvement in low intensity speed. High amounts of iridium will result in a degradation of the latent image even when the time lapse between exposure and processing is short, usually one hour or less. Combinations of iridium and nitrosyl complex, while maintaining the high contrast with low intensity exposures, will also lessen the degradation of latent image. Suitably the amount is between about 10 and about 350 molar parts parts per billion of iridium. A preferred amount has been found to be about 70 molar parts per billion of iridium for the preferred silver chloride grains when utilized with an amount of about 36 molar parts per billion of nitrosyl complex.

The nitrosyl complex and iridium may be added at any suitable time in the emulsion making process. Generally, it has been found to be preferred that the nitrosyl complex be run throughout the grain making process as a dopant, as this produces a grain having the desired properties. In contrast, it has been found preferable to band the iridium near the surface of the grain by adding it late in the grain forming process. It has been found that the iridium be banded by addition to the emulsion make at a point between about 90 and about 95 percent of the final grain volume having been precipitated, with a preferred banding at between about 93 and about 95 percent of the grain volume addition during emulsion making. The iridium and nitrosyl complex treatment may be performed for grains to be utilized in any layer of the color paper or other photographic product. The grains are suitable for improving performance of magenta, cyan or yellow layers.

The source of transition metal nitrosyl complex and iridium may be any material that will be incorporated in he grain when forming silver halide particles. Osmium is the preferred transition metal. The nitrosyl complex compounds as disclosed in U.S. Pat. No. 4,933,272 may be utilized. Suitable for the invention are $[Os(NO)Cl_5]^{-2}$
$[Os(NO)Br_5]^{-2}$
$[Os(NO)I_5]^{-2}$
$[Os(NO)F_5]^{-2}$
$[Os(NO)Cl_4(TeCN)]^{-2}$
$[Os(NO)Br_4(OCN)]^{-2}$
$[Os(NO)I_4(TeCN)]^{-2}$
$[Os(NO)Cl_4(SeCN)]^{-2}$
$[Os(NO)Br_4(SeCN)]^{-2}$
$[Os(NO)I_4(SeCN)]^{-2}$
$[Os(NO)Cl_3(CN)_2]^{-2}$
$[Os(NO)Br_2(CN)_3]^{-2}$
$[Os(NO)I_2(SCN)_3]^{-2}$
$[Os(NO)Cl_2(SCN)_3]^{-2}$
$[Os(NO)Cl(CN)_4]^{-2}$
$[Os(NO)Br(CN)_4]^{-2}$
$[OS(NO)I(SCN)_4]^{-2}$
$[Os(NO)(CN)_5]^{-2}$ Preferred materials have been found to be $Cs_2Os(NO)Cl_5$ and $K_2Os(NO)Cl_5$.

The iridium can be added as a halide salt or complex, in the trivalent or tetravalent state such as iridium halides, alkali metal iridium halide, alkaline earth metal iridium halide, and alkyl- and aryl-ammonium iridium halide, e.g., iridium (III) chloride, iridium (IV) chloride, potassium hexachloroiridate (III), potassium hexachloroiridate (IV), and ammonium hexachloroiridate (III) or (IV). A preferred source of iridium has been found to be iridium chloride $IrCl_6$ complexed as the potassium $K_3$ or $K_4$ salt.

After formation of the iridium and nitrosyl complex doped silver halide grains, the emulsions of the grains are washed to remove excess salt, and then they may be chemically and spectrally sensitized in any conventional manner as disclosed in the above referenced *Research Disclosure* 308119. After sensitizing, the emulsions may be combined with any suitable coupler and/or coupler dispersants to make the desired color film or print photographic materials. They also may be used in black-and-white photographic films and print material.

EXAMPLES

The following examples are intended to be illustrative and not exhaustive of methods of formation of the invention and grains formed by the invention.

Preparation of Emulsions

Solutions utilized for emulsion preparation

| | | |
|---|---|---|
| Solution A | | |
| Gelatin | 21.0 | g |
| 1,8 dithiooctanediol | 10.5 | mg |
| Water | 532.0 | cc |
| Solution B | | |
| Silver Nitrate | 170.0 | g |
| Water | 467.8 | cc |
| Solution C | | |
| Sodium Chloride | 58.0 | g |
| Water | 480.0 | cc |
| Solution D | | |
| Sodium Chloride | 58.0 | g |
| $Cs_2Os(NO)Cl_5$ | 2.4 | micrograms |
| Water | 480.0 | cc |
| Solution E | | |
| Sodium Chloride | 58.0 | g |
| $K_3IrCl_6$ | 37.0 | mirograms |
| Water | 480.0 | cc |

Solution A was placed in a reaction vessel and stirred at 46° C. To produce emulsion 1, solutions B and C were added simultaneously at constant flow rates while controlling the silver potential at 1.5 pCl. Flow rates are about 0.53 moles per minute unless otherwise indicated in these emulsion preparations. The emulsion was then washed to remove excess salts. The emulsion grains were cubic and had an edge length of 0.384 microns.

Emulsion 2 was prepared by placing solution A in a reaction vessel and stirring at a temperature of 46° C. Solutions B and D were added simultaneously at constant flow rates for 93% of the grain volume. The silver potential was controlled at 1.5 pCl. After 93% of the grain volume was achieved, solution C was used in place of solution D for the remainder of the reaction. The emulsion was washed to remove excess salts. The grains were cubic with an edge length of 0.391 microns.

Emulsion 3 was prepared in a similar manner to emulsion 1 except that after 93% of the grain volume was achieved, solution C was replaced with solution E until 95.3% of the grain volume was achieved. Then solution E was replaced with solution C for the remainder of the reaction. The emulsion was washed to remove excess salts. The grains were cubic with an edge length of 0.390 microns.

Emulsion 4 was prepared by charging the reaction vessel with solution A at 46° C. with stirring. Solutions B and D were added simultaneously at constant flow rates until 93% or the grain volume was achieved. Then solution E was substituted for solution D until 95.3% of the grain volume was achieved, at which point solution C was substituted for solution E for the remainder of the reaction. The silver potential was controlled at 1.5 pCl. The emulsion was washed to remove excess salts.

The grains were cubic and had an edge length of 0.383 microns.

| Emulsion | Dopant | *Dopant Position % of Grain | Level Per Mole AgX | Cubic Edge Length (Microns) |
|---|---|---|---|---|
| 1 | None | — | — | 0.384 |
| 2 | $Cs_2Os(NO)Cl_5$ | 0–93 | 2.4 microgram | 0.391 |
| 3 | $K_3IrCl_6$ | 93–95.3 | 0.037 milligram | 0.390 |
| 4 | $Cs_2Os(NO)Cl_5$ | 0–93 | 2.4 microgram | |
| | $K_3IrCl_6$ | 93–95.3 | 0.037 milligram | 0.383 |

*Percent of silver halide (by weight) supplied to the emulsion during dopant addition

D:

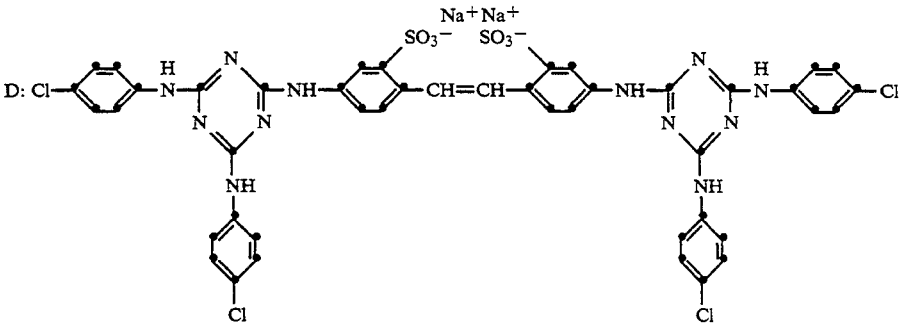

APMT = 1-(3-acetamidophenyl)-5-mercaptotetrazole

Dye A =

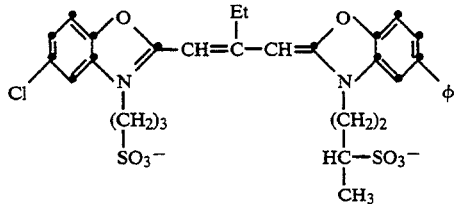

Dye B =

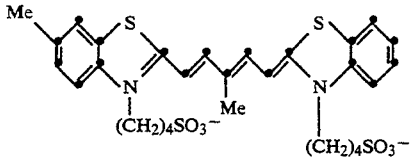

Dye C =

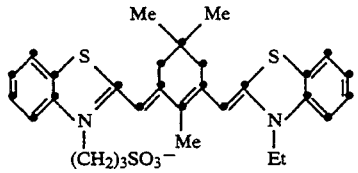

Coupler Y = N-[4-chloro-3-[[4,5-dihydro-5-oxo-1-(2,4,6-trichlorophenyl)-1H-pyrazol-3-yl]amino]-phenyl]-2-[3-(1,1-dimethylethyl)-4-hydroxy-phenoxy]-tetradecanamide Coupler X = 2-[2,4-bis(1,1-dimethyl propyl)phenoxy]-N-(3,5-dichloro-4-ethyl-2-hydroxyphenyl)-butanamide

Examples 1–8

Each of the four emulsions described above were melted at 40° C. Each emulsion was charged with 35 mg sensitizing dye A, and 5 mg $Na_2S_2O_3$+5 mg $KAuCl_4$. The emulsions were then digested at 65° C. In addition, 290 mg APMT, 1710 mg KBr, and 130 mg stilbene compound D were added. The emulsions were split and to half of the emulsions, 17.4 mg Dye C was added; to the other half, 25.0 mg Dye B was added. The emulsions were coated on a paper support at 183 mg/m$^2$ along with 448 mg/m$^2$ cyan forming coupler X. A 1076 mg/m$^2$ gel overcoat was applied as a protective layer. The coatings were exposed for 10 seconds and 500 seconds using a WR12 filter and were processed at 35° C. as follows:

| | |
|---|---|
| color development | 45 sec. |
| bleach-fix (FeEDTA) | 45 sec. |
| wash | 3 min. |
| Developer composition: | |
| 4-amino-3-methyl-N-ethyl-betahydroxy-ethylanaline sulfite | 5.0 g/l |
| Triethanolamine (99%) | 11.0 c/l |
| $LiSO_4$ | 2.7 g/l |
| $K_2CO_3$ | 25.0 g/l |
| $K_2SO_3$ 45% | 0.5 cc/l |
| KBr | 0.025 g/l |
| KCl | 1.3 g/l |

-continued

| | |
|---|---|
| Water to 1 liter, pH adjusted to | 10.12 |

After processing, the coatings were read with a reflection densitometer and the results for examples 1–8 are in Table I. The data in Table I shows that the nitrosyl complex gives a lower toe value which results in higher contrast with the shorter exposure time (emulsion 2), while the iridium dopant lessens the amount of change for the responses in the long, low intensity exposure (emulsion 3). The combination of the dopants (emulsion 4) shows an improved position compared to the controls due to both a sharp toe and an improvement in the change due to a low intensity exposure. Also, the lessening of the values due to the time between exposure and processing can be seen with the invention (emulsion 4) over the iridium containing emulsion (emulsion 3).

TABLE I

| | | | 10-sec. Exposure | | Change from 10 sec. to 500 sec. | | |
|---|---|---|---|---|---|---|---|
| Example | Emulsion | Dye | Speed (a) | Toe (b) | Δ Speed | ΔToe | LIK(c) ΔToe |
| 1 (control) | 1 | C | 1.04 | 0.32 | −0.35 | +0.04 | −0.008 |
| 2 (control) | 2 | C | 1.04 | 0.26 | −0.28 | +0.04 | +0.017 |
| 3 (control) | 3 | C | 1.10 | 0.31 | −0.16 | +0.01 | −0.075 |
| 4 (invention) | 4 | C | 0.94 | 0.28 | −0.13 | +0.02 | −0.033 |
| 5 (control) | 1 | B | 1.02 | 0.32 | −0.36 | +0.06 | −0.005 |
| 6 (control) | 2 | B | 0.96 | 0.27 | −0.28 | +0.06 | +0.008 |
| 7 (control) | 3 | B | 0.96 | 0.30 | −0.10 | −0.01 | −0.055 |
| 8 (invention) | 4 | B | 0.90 | 0.29 | −0.11 | +0.01 | −0.021 |

(a) Speed is defined in log E required to reach a density of 1.0
(b) Toe is density measurement at 0.3 Log E faster than speed point
(c) Change from 30-second to 30-minute delay between exposure and processing

Examples 9–16

Each of the four emulsions described above were melted at 40° C. Each emulsion was charged with 35 mg sensitizing dye A and 28 mg of a gold sensitizing as disclosed in U.S. Pat. No. 2,642,316. The emulsions were then digested at 65° C. In addition, 275 mg APMT, 933 mg KBr and 235 mg silbene compound D was added. The emulsions were then split and to half of the emulsions, 17.4 mg Dye C was added; to the other half, 25.0 mg of Dye B was added. The emulsions were coated and processed as in Examples 1–8. These results are shown in Table II and again show the improvement with the invention. The emulsion with the combination of dopants has the lower toe value along with less change in the responses with a long, low intensity exposure. The controls give either a sharp toe or an improved low intensity position, but only the invention shows improvement with both responses.

TABLE II

| | | | 10-sec. Exposure | | Change From 10-sec. to 500-sec. Exposure | |
|---|---|---|---|---|---|---|
| Example | Emulsion | Dye | Speed (a) | Toe (b) | Δ Speed | ΔToe |
| 9 (control) | 1 | C | 1.00 | 0.30 | −0.30 | +0.10 |
| 10 (control) | 2 | C | 0.98 | 0.26 | −0.26 | +0.10 |
| 11 (control) | 3 | C | 0.99 | 0.33 | −0.19 | +0.07 |
| 12 (invention) | 4 | C | 0.96 | 0.31 | −0.13 | +0.05 |
| 13 (control) | 1 | B | 0.84 | 0.36 | −0.34 | +0.12 |
| 14 (control) | 2 | B | 0.87 | 0.28 | −0.32 | +0.14 |
| 15 (control) | 3 | B | 0.71 | 0.35 | −0.31 | +0.14 |
| 16 (invention) | 4 | B | 0.94 | 0.32 | −0.18 | +0.09 |

(a) Speed is defined in log E required to reach a density of 1.0
(b) Toe is density measurement at 0.3 Log E faster than speed point

Examples 17–20

The emulsions as described above were melted at 40° C. To each emulsion was added 280 mg of Sensitizing Dye A, 6.8 mg sodium thiosulfate, and 4.2 mg potassium chloroaurate. The emulsions were then digested at 65° C. Prior to coating the emulsions on a paper support, 1145 mg KBr, 192 mg APMT and 6613 mg KCl were added to the emulsions. The emulsions were coated with dye forming coupler Y with laydown of Ag at 280 mg/m$^2$ and coupler Y at 448 mg/m$^2$. A gel layer as in Examples 1–8 was coated over the emulsion plus coupler layer for protection. The exposure and processing was similar to that described for Examples 1–8. The results are shown in Table III and again demonstrate the advantage for the invention as both a sharp toe and less change due to long, low intensity exposure is seen.

TABLE III

| | | 10-sec. Exposure | | Change From 10-sec. to 500-sec. Exposure | |
|---|---|---|---|---|---|
| Example | Emulsion | Speed (a) | Toe (b) | Δ Speed | ΔToe |
| 17 (control) | 1 | 2.04 | 0.33 | −0.28 | +0.05 |
| 18 (control) | 2 | 1.95 | 0.28 | −0.22 | +0.04 |
| 19 (control) | 3 | 2.07 | 0.35 | −0.09 | +0.01 |
| 20 (invention) | 4 | 1.90 | 0.28 | −0.08 | +0.01 |

(a) Speed is defined in log E required to reach a density of 1.0
(b) Toe is density measurement at 0.3 Log E faster than speed point

Examples 21–24

The emulsions as described above were melted at 40° C. To each emulsion was added 333 mg of sensitizing dye A and 20 mg of a gold sensitizer as described in U.S. Pat. No. 2,642,361. The emulsion was digested at 65° C. Prior to coating, 380 mg APMT, 1320 mg KBr, and 6613 mg KCl were added to the emulsions. The emulsions were coated, exposed, and processed as in Examples 17–20. The results are shown in Table IV. Again, the advantage of the invention is apparent as a sharp toe with less change on long, low intensity exposure results from the combination of the dopants.

TABLE IV

| Example | Emulsion | 10-sec. Exposure Speed (a) | 10-sec. Exposure Toe (b) | Change From 10-sec. to 500-sec. Exposure Δ Speed | Change From 10-sec. to 500-sec. Exposure ΔToe |
|---|---|---|---|---|---|
| 21 (control) | 1 | 1.88 | 0.35 | −0.31 | +0.13 |
| 22 (control) | 2 | 1.80 | 0.30 | −0.26 | +0.12 |
| 23 (control) | 3 | 1.86 | 0.37 | −0.09 | +0.04 |
| 24 (invention) | 4 | 1.76 | 0.33 | −0.08 | +0.03 |

(a) Speed is defined in log E required to reach a density of 1.0
(b) Toe is density measurement at 0.3 Log E faster than speed point

Examples 25-27

Emulsion 5 was prepared in a manner similar to emulsion 4 except that solutions B and E were run simultaneously at constant flow rates until 93% of the grain volume was achieved. Then solution D was substituted for solution E until 95.3% of the grain volume was achieved.

Emulsions 3, 4, and 5 were melted at 40° C. Each emulsion was charged with 17.8 mg of a gold sensitizer as disclosed in U.S. Pat. No. 2,642,361. The emulsions were digested at 65° C. and additions of 1306 mg KBR, 300 mg APMT, and 20 mg dye C followed. The emulsions were coating in the manner described for Examples 1-8. The exposures used for these examples were 1/10 second and 100 seconds with a WR12 filter. The processing was similar to that described for Examples 1-8. The results are given in Table V.

TABLE V

| Example | Emulsion | Dopant | Location in Grain | 0.1 sec.-Exposure Speed (a) | 0.1 sec.-Exposure Toe (b) | Change From 0.1-sec. to 100-sec. ΔSpeed | Change From 0.1-sec. to 100-sec. ΔToe | LIK (c) 30" to 30' ΔToe |
|---|---|---|---|---|---|---|---|---|
| 25 | 3 (control) | $K_3IrCl_6$ | 93-95.3% | 1.18 | 0.39 | −0.27 | +0.09 | −0.061 |
| 26 | 4 (invention) | $K_3IrCl_2$ + $Cs_2Os(NO)Cl_5$ | 93-95.3% 0-93% | 1.11 | 0.34 | −0.26 | +0.09 | −0.030 |
| 27 | 5 (comparision) | $K_3IrCl_2$ + $Cs_2Os(NO)Cl_5$ | 0-93% 93-95.3% | .97 | 0.32 | −0.19 | +0.15 | −0.205 |

(a) Speed is defined in log E required to reach a density of 1.0
(b) Toe is density measurement at 0.3 Log E faster than speed point
(c) Change from 30-second to 30-minute delay between exposure and processing The results in Table V again show that the combination of dopants gives a sharper toe emulsion and that the change due to low intensity exposure is maintained when compared to iridium doped emulsion. Also, the change due to the time between exposure and processing is improved with the combination of dopants. However, if the location of the dopants is reversed as in Example 27, from the preferred invention of Example 26, the change due to the time between exposure and process is severely degraded.

The invention has been described in detail with particular reference to preferred embodiments thereof, but it will be understood that variations and modifications can be effected within the spirit and scope of the invention.

We claim:

1. A photographic silver halide emulsion comprising radiation sensitive silver halide grains doped with a combination of iridium and an osmium complex with a nitrosyl ligand wherein said ligand is present throughout said grains, and wherein said iridium present in said emulsion is added to the grain from a halide salt or a halide salt complex wherein said osmium complex with a nitrosyl ligand is present in an amount between about 0.03 and 36 molar parts per billion said iridium is present at between about 10 and about 350 molar parts per billion of said silver halide and said iridium is present in about the exterior 10 percent by volume of said grain.

2. The emulsion of claim 1 wherein said silver halide comprises silver chloride.

3. The emulsion of claim 1 wherein said osmium complex with a nitrosyl ligand is present as $K_2Os(NO)Cl_5$ or $Cs_2Os(NO)Cl_5$.

4. A photographic emulsion comprising gelatin and silver halide grains comprising an osmium complex with a nitrosyl ligand throughout said grain and iridium present in about the outer 10 percent by volume of said grain and wherein said iridium present in said emulsion is added to the grain from a halide salt or a halide salt complex, said transition metal complex with a nitrosyl ligand comprises $K_2Os(NO)Cl_5$ or $Cs_2Os(NO)Cl_5$ present in an amount between about 0.03 and about 36 molar parts per billion, and said iridium is present in an amount between about 10 and about 350 molar parts per billion of said grain.

5. The emulsion of claim 4 wherein said silver halide comprises silver chloride.

6. The emulsion of claim 4 wherein said osmium complex with a nitrosyl ligand comprises $CS_2Os(NO)Cl_5$.

7. A photographic element wherein at least one layer of said element comprises silver halide grains doped with a combination of an osmium complex with a nitrosyl ligand, and iridium wherein said ligand is present throughout said grains and wherein said iridium present in said emulsion is added to the grain from a halide salt or a halide salt complex wherein said osmium complex with a nitrosyl ligand is present in an amount between about 0.03 and 36 molar pans per billion; said iridium is present at between about 10 and about 350 molar pans per billion of said silver halide and said iridium is present in about the exterior 10 percent by volume of said grain.

8. The photographic element of claim 7 wherein said osmium complex with a nitrosyl ligand comprises osmium and cesium.

* * * * *